US009758354B2

(12) United States Patent
Richter

(10) Patent No.: US 9,758,354 B2
(45) Date of Patent: Sep. 12, 2017

(54) POLE GUIDE COVER

(71) Applicant: Altec Industries, Inc., Birmingham, AL (US)

(72) Inventor: Ryan A. Richter, Saint Joseph, MO (US)

(73) Assignee: Altec Industries, Inc., Birmingham, AL (US)

( * ) Notice: Subject to any disclaimer, the term of this patent is extended or adjusted under 35 U.S.C. 154(b) by 275 days.

(21) Appl. No.: 14/303,006

(22) Filed: Jun. 12, 2014

(65) Prior Publication Data

US 2015/0360917 A1 Dec. 17, 2015

(51) Int. Cl.

| | |
|---|---|
| ***B66C 1/62*** | (2006.01) |
| ***B66C 1/68*** | (2006.01) |
| *E04H 12/34* | (2006.01) |

(52) U.S. Cl.

CPC ..... *B66C 1/62* (2013.01); *B66C 1/68* (2013.01); *E04H 12/34* (2013.01)

(58) Field of Classification Search

CPC ... B66C 1/62; B66C 1/68; B66F 9/183; B66F 9/184; B66F 9/186; B66F 9/187; E04H 12/34; E04H 12/347; Y10T 24/44556; Y10T 24/44641

USPC ..... 212/231, 264; 294/106; 414/23, 733, 414/739

See application file for complete search history.

(56) References Cited

U.S. PATENT DOCUMENTS

| | | | | |
|---|---|---|---|---|
| 2,690,271 | A * | 9/1954 | Marietta | B66F 9/184 414/623 |
| 3,628,675 | A | 12/1971 | Balogh | |
| 5,302,440 | A | 4/1994 | Davis | |
| 5,931,201 | A | 8/1999 | Hsich | |
| 6,729,832 | B1 * | 5/2004 | Word, III | B66F 9/0655 294/104 |
| 8,171,594 | B2 | 5/2012 | Cox et al. | |
| 9,139,402 | B2 * | 9/2015 | Dodge, IV | B66C 1/445 |
| 2012/0060980 | A1 | 3/2012 | Ledoux et al. | |
| 2012/0070647 | A1 | 3/2012 | O'Neill | |

FOREIGN PATENT DOCUMENTS

| | | | |
|---|---|---|---|
| CN | WO 2008006282 A1 * | 1/2008 | A47G 21/10 |
| KR | 20110134345 A * | 12/2011 | |

* cited by examiner

*Primary Examiner* — Michael McCullough
*Assistant Examiner* — Brendan Tighe
(74) *Attorney, Agent, or Firm* — Erise IP, P.A.

(57) ABSTRACT

A sacrificial polymer pole guide cover for the use of covering one or more pole guide tongs in a pole guide. The pole guide cover has a generally arcuate body presenting a length and that is curved along the length. The pole guide cover further presents a concave interior surface along the length and a convex exterior surface along the length. A channel is formed in at least a portion of the length of the convex exterior surface. The channel is shaped to complementally receive at least a portion of a pole guide tong. The pole guide cover also has a mounting assembly for removably mounting the pole guide cover to the pole guide tong.

16 Claims, 6 Drawing Sheets

POLE GUIDE COVER

BACKGROUND

1. Field

Embodiments of the invention relate to pole guides for utility vehicles and the like. More particularly, embodiments of the invention relate to a pole guide tong with a polymer pole guide cover.

2. Related Art

A utility pole is a column or post used to support lines providing various public utilities, such as electric power, Internet and television cable, phone cable, and fiber optic cable. Utility poles also provide support for other equipment, such as street lights, traffic lights, cellular network antennas, transformers, capacitors, reclosers, and fuses. Utility poles are typically constructed from various species of wood but can also be constructed from steel, concrete, and composites such as fiberglass. Some utility poles, especially dead-end or termination poles, are supported by guy-wires. Utility poles may also be tagged, branded, or otherwise marked to identify critical information. Other names for utility poles include transmission pole, telephone pole, telecommunication pole, telegraph pole, and telegraph post.

Construction and utility equipment may be equipped to lift, move, and place heavy loads, such as utility poles. Such equipment may include a boom and a winch for engaging and moving heavy loads. By way of example, digger derricks and similar utility vehicles are used to set utility poles and the like by digging or drilling holes and then placing the utility poles into the holes. Digger derricks may include an auger to dig the hole, a winch to lift the pole, and a pole guide mounted on a boom to stabilize and guide the placement of the pole as the pole is positioned and then placed in the hole using the boom and winch.

Pole guides typically include a pair of metal arms or grapple tongs, known as pole guide tongs, that each have a generally arcuate shape for selectively engaging and securing the pole as the pole is lifted. The pole guide arms are used in pairs to pincer the load. With the pole secured by the pole guide, the boom can then be moved to position the pole to be placed into the drilled hole. To effectively engage the pole, the arms of the pole guide protrude outward from the boom.

The pole guide tongs are typically 0.75 inches thick and may bite into the utility pole or other load being guided. This biting can cause the load to bind to the pole guides. This biting, and the resultant removal process, may result in damage to both the load and the pole guide assembly. The biting is a result, in part, of the narrow and often metallic pole guide tongs pressing firmly against the utility pole, which is often made of wood or a relatively soft material.

SUMMARY

Embodiments of the invention solve the above-mentioned problems by providing a pole guide cover for an inside and an endmost edge of the pole guide tongs. The pole guide cover provides a wider area over which the pinching load is distributed, which reduces binding. The pole guide cover reduces damage to the load by utilizing a softer polymer material to cover the metal of the pole guide. The pole guide cover reduces damage to the pole guide by providing an insulator between the pole guide and the utility pole. Should the pole guide cover become damaged, it is an easily removable and replaceable component and substantially less expensive than the pole guide.

A pole guide cover in accordance with a first embodiment of the invention has a generally arcuate body presenting a length and being curved along the length. The pole guide cover body presents a concave interior surface along the length and a convex exterior surface along the length. The pole guide cover according to this first embodiment of the invention further comprises a channel formed in at least a portion of the length to form the convex exterior surface. This channel is shaped to complementally receive at least a portion of a pole guide tong. The pole guide cover also comprises a mounting assembly for removably mounting the pole guide cover to the pole guide tong.

A pole guide assembly in accordance with a second embodiment of the invention comprises an extendable boom and a pole guide base attached thereto. The pole guide base has at least one pair of pole guide tongs rotationally attached at one or more attachment points. A pole guide tong is at least partially covered by a pole guide cover. The pole guide cover is securely, but removably, attached to the pole guide tong.

A method of using a pole guide to move a load in accordance with still another embodiment of the invention comprises receiving a pole guide, having pole guide tongs at least partially covered by a pole guide cover; opening the pole guide by rotating a distal end on each of the pole guide tongs away from the other; moving the pole guide to an engaged position adjacent to a load; closing the pole guide to secure the load such that the pole guide cover is positioned between the pole guide tong and the load; and moving the load into a desired position or location by moving the pole guide.

Still other embodiments of the invention can be utilized for other applications. While the current invention is designated a pole guide cover, this is not to be construed as limiting the invention to only one application. Embodiments of the invention could be utilized for a number of applications. These include, but are not limited to, the transportation and placement of other posts and heavy loads, such as in the construction of fences, bridges, buildings, and other structures.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWINGS

Embodiments of the invention are described in detail below with reference to the attached drawing figures, wherein.

Figure 1:
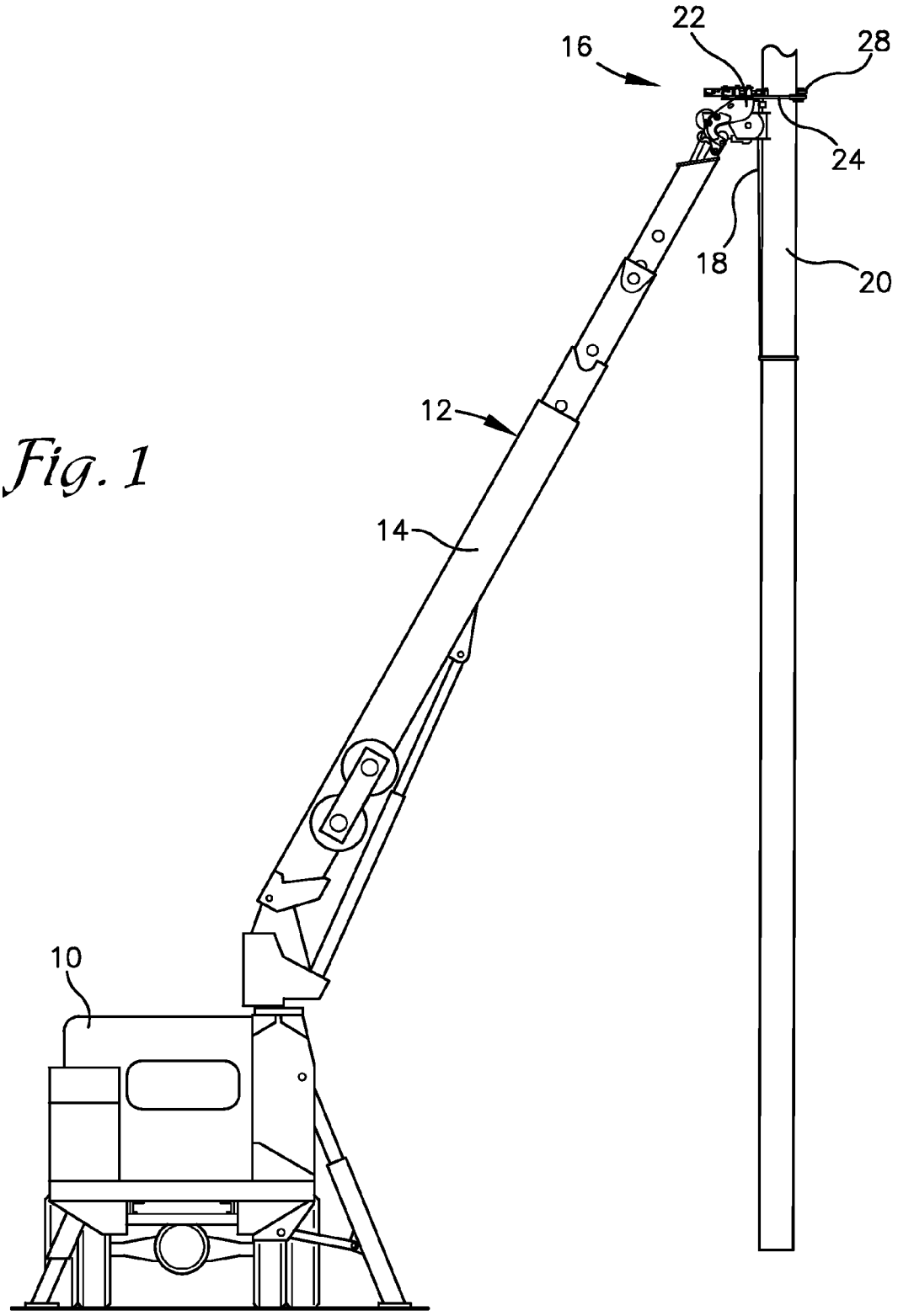
FIG. 1 is a side view of an exemplary utility vehicle equipped with a boom and a pole guide mounted on the boom, the pole guide shown engaging a load.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention may be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etcetera described in one embodiment may also be included in other embodiments, but is not necessarily included. Thus, the invention can include a variety of combinations and/or integrations of the embodiments described herein.

Turning now to the drawings, an exemplary utility vehicle 10 with a boom assembly 12 including a boom 14 and a pole guide assembly 16 is illustrated in FIG. 1. The boom assembly 12 is mounted on the vehicle 10 to enable rotational and/or pivotal movement relative to a frame of the vehicle 10 and includes a load line 18 for attaching to and lifting a load in a conventional manner. The illustrated boom 14 comprises a plurality of nested boom sections that may be telescopically extended and retracted. However, in other embodiments of the invention, the boom 14 may comprise a single, non-telescoping section. The vehicle 10 may further include additional implements or tools not depicted in the drawings, such as an auger attached to the boom for drilling a hole for utility pole placement.

The pole guide assembly 16 is secured to a distal end of the boom 14 and is positioned to engage, secure, and stabilize a load 20 held by the load line 18 and guide the load 20 into a desired position. In other embodiments of the invention, the pole guide assembly 16 does not utilize a load line 18, for example, if the load is relatively lightweight. By way of example, the load 20 may be a utility pole wherein the pole guide assembly 16 engages and stabilizes the utility pole while the boom 14 lifts and positions the pole to be placed in a hole. By way of another example, the load 20 could be a fence post. By way of yet another example, the load 20 could be a beam for the construction of a structure. The load could also be any other object that has a section thereof which could be gripped by the pole guide assembly 16.

Figure 2:
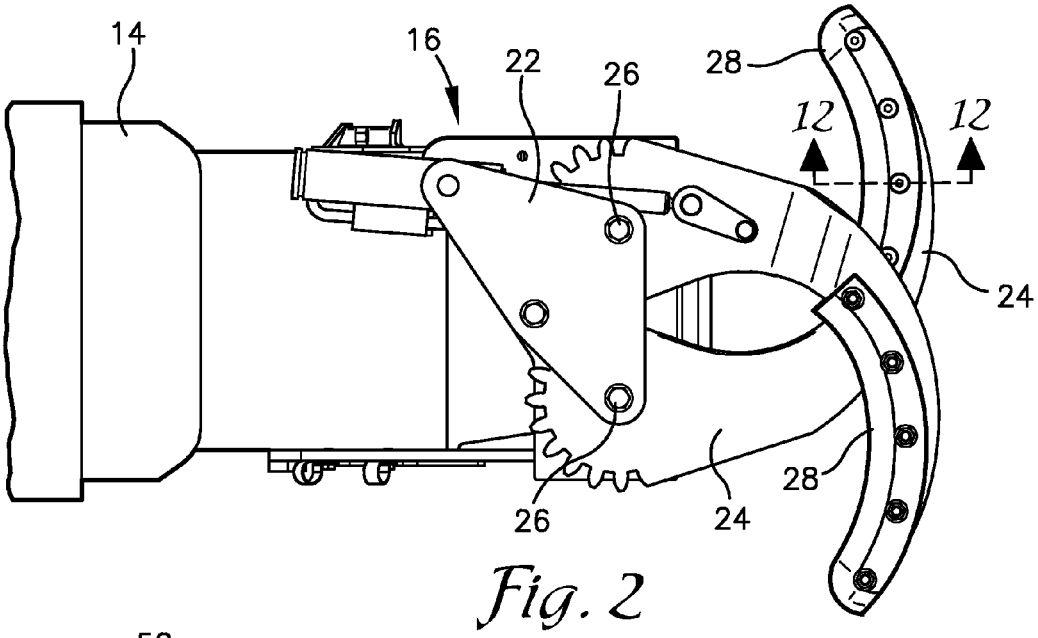
FIG. 2 is a plan view of the pole guide of the exemplary utility vehicle of FIG. 1, illustrating a distal end portion of the boom and a pole guide mounted on the boom.
Figure 12:
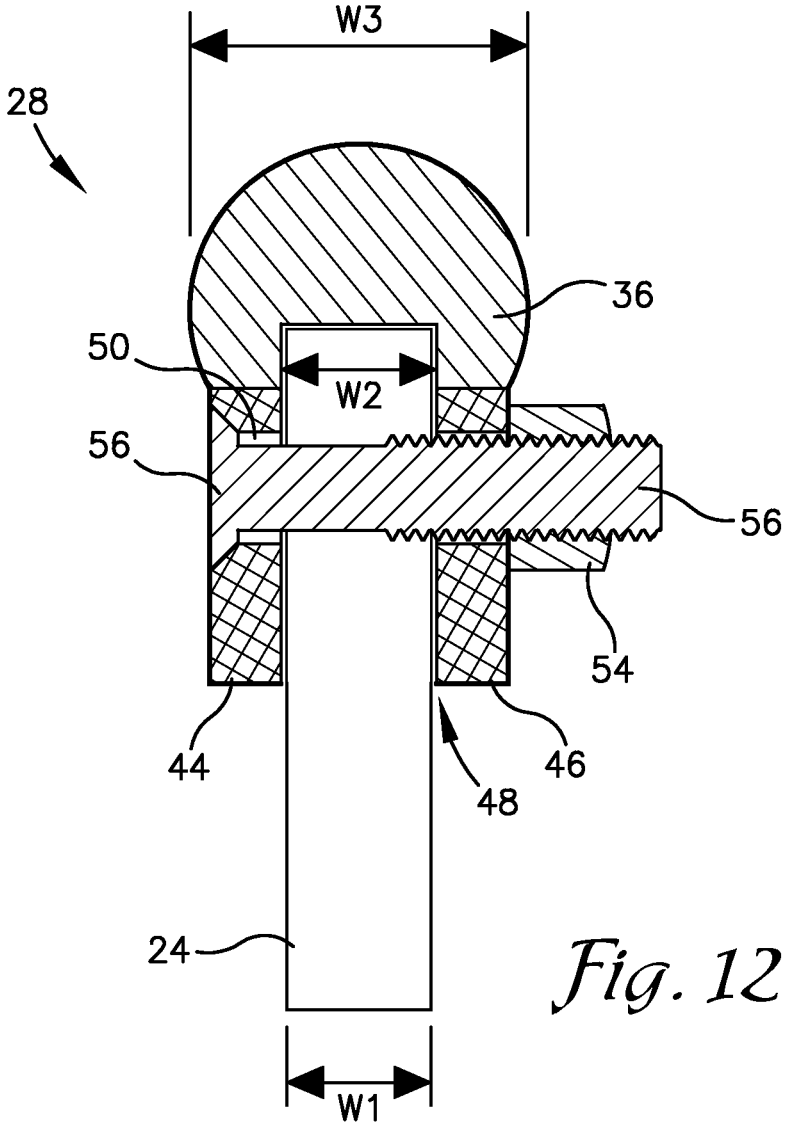
FIG. 12 is a horizontal cross-sectional view of the first embodiment of the pole guide cover, pole guide tong, bolt, and nut through the line 12-12 of FIG. 2.

With particular reference to FIG. 2, an exemplary pole guide assembly 16 includes at least a base 22 and two or more pole guide tongs 24 secured to the base 22. The pole guide tongs 24 present a generally arcuate shape, a length, and a width W1, as depicted in FIG. 12. In some embodiments of the invention, the width W1 is approximately equal along the length of the pole guide tong. In other embodiments of the invention, the width W1 can vary along the length. The pole guide tongs 24 are rotationally secured, such that each can rotate around an attachment point 26. In some embodiments of the invention, a pair of pole guide tongs 24 share a single attachment point 26. In other embodiments of the invention, each pole guide tong 24 has a separate attachment point 26, as illustrated in FIG. 2. The base 22 may be pivotably attached to the distal end of the boom 14. Each pole guide tong 24 presents an inwardly-arcuate shape for engaging a load, such that the pole guide assembly 16 is operable to pincer the load between the two or more pole guide tongs 24. In some embodiments of the invention, one of the pole guide tongs 24 is offset and slightly higher or lower than the other, allowing the two pole guide tongs 24 to lay side-by-side instead of having the ends touch when in a closed position.

Figures 8, 9:
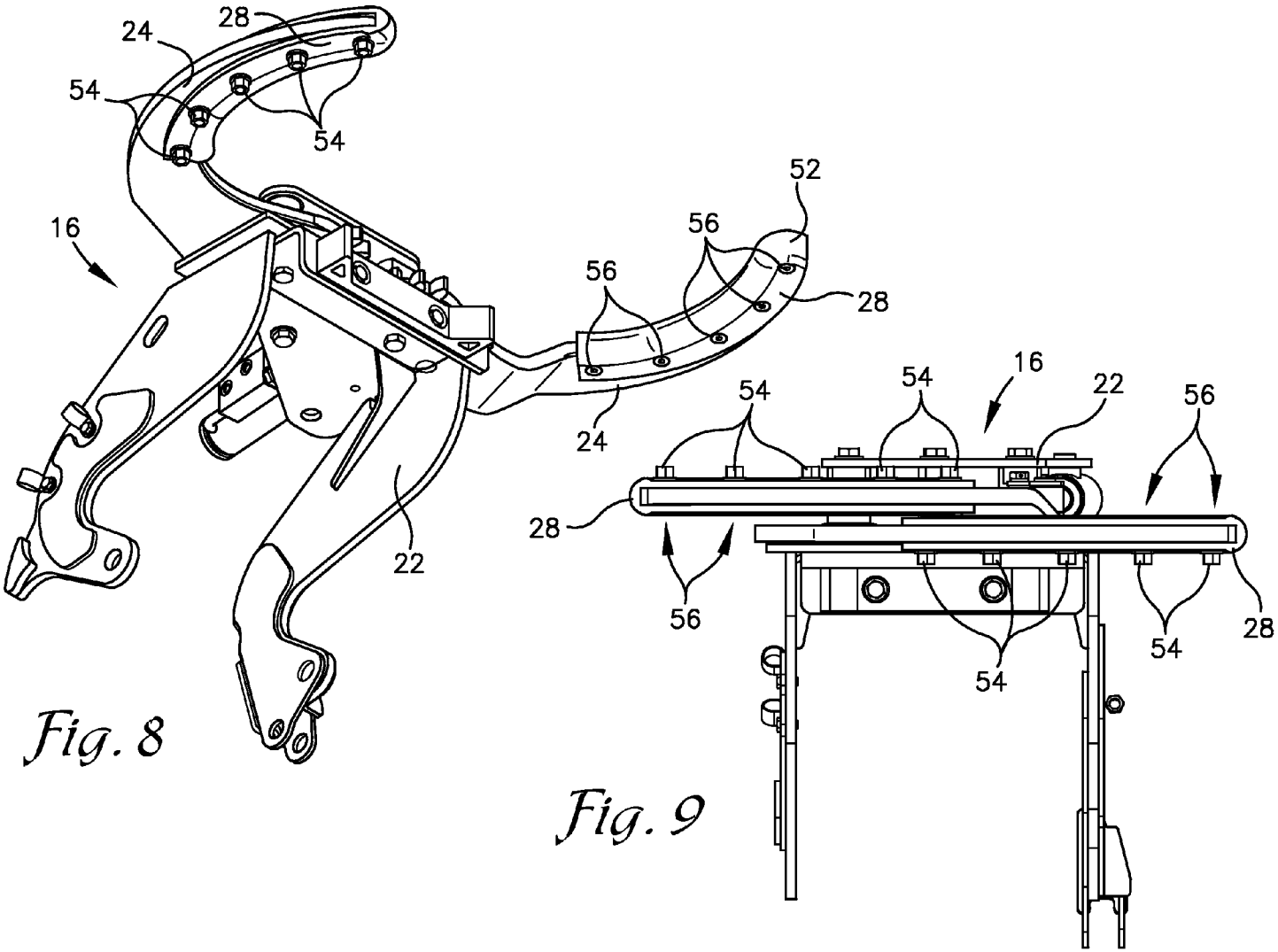
FIG. 8 is a bottom perspective view of the exemplary pole guide and particularly illustrating the pole guide tongs in the open position.
FIG. 9 is a front view of the exemplary pole guide, illustrating how two pole guide covers of the first embodiment will be substantially parallel and adjacent when the pole guide is in the closed position.
Figure 10:
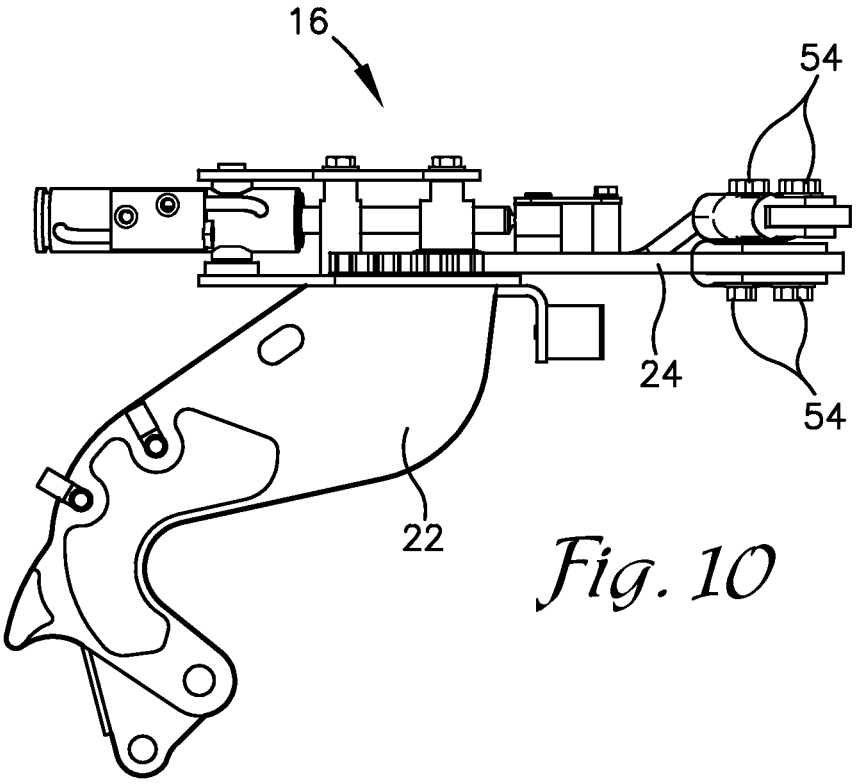
FIG. 10 is a side view of the exemplary pole guide illustrated in FIG. 9.

To operate the pole guide assembly 16, an operator rotates the pole guide tongs 24 to the open position by moving a distal end of one of the pole guide tongs 24 away from the other pole guide tong 24. This can be accomplished manually, mechanically, pneumatically, electrically, or a combination thereof. With the pole guide tongs 24 in the open position, as shown in FIG. 8, the operator moves the boom 14 vertically and horizontally as necessary and extends or retracts the boom 14. This operation is performed until the load 20 is located against the base 22, or close thereto, and between the pole guide tongs, or close thereto. The operator then ceases or slows movement of the boom 14. The operator then moves the pole guide tongs 24 to the closed position by rotating their distal ends toward one another, such that the pole guide tongs 24 come in contact with both sides of the load 20. Again, this can be done manually, mechanically, pneumatically, electrically, or a combination thereof. A pressure is then continuously, or nearly continuously, applied to the load 20 by the pole guide tongs 24, such that the load 20 is held securely by the pole guide tongs 24 and base 22. The operator then moves the boom 14, and by extension moves the load 20, into a desired position, orientation, or location.

As used herein, "operator" refers to a person using or utilizing the pole guide assembly 16 or assisting therewith, a person performing maintenance on the pole guide assembly 16, a supervisor overseeing the operation of the pole guide assembly 16, or other person consistent with the context.

In embodiments of the invention, each of the pole guide tongs 24 is provided with a pole guide cover 28. The pole guide cover 28 for each pole guide tong 24 is substantially the same, such that the pole guide cover 28 for placement on a left pole guide tong 24 of the pole guide assembly is substantially the same as a pole guide cover 28 for placement on a right pole guide tong 24 of the pole guide assembly 16.

With particular reference to FIGS. 3-6, the pole guide cover 28 broadly comprises an arcuate body 30 presenting a concave interior surface 32 and a convex exterior surface 34. The arcuate body 30 is formed from an engagement segment 36 and a mounting segment 38. As discussed below, the engagement segment 36 and mounting segment 38 are coupled together, such that the engagement segment 36 extends longitudinally along the concave interior surface 32 of the arcuate body 30, and the mounting segment 38 extends longitudinally along the convex exterior surface 34 of the body. The arcuate body 30 further presents a proximal end 40 and a distal end 42.

Figure 3:
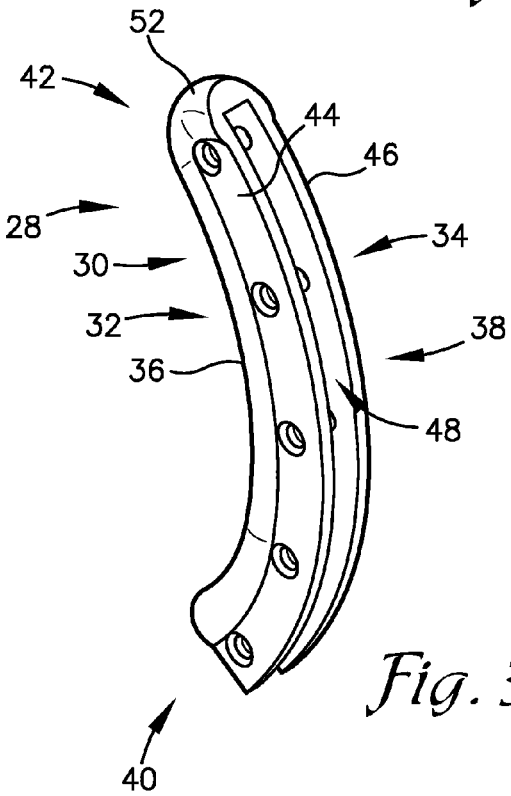
FIG. 3 is a rear perspective view of one embodiment of the pole guide cover.

Referring to FIG. 3, the mounting segment 38 comprises a left mounting plate 44 and a right mounting plate 46, each presenting a length. In some embodiments of the invention, the pole guide tongs 24 overlap when the pole guide assembly 16 is in a closed position. In this embodiment, the left mounting plate 44 is on a side that would be adjacent or proximate to the other pole guide cover 28 in the pole guide assembly 16. As used herein, the right mounting plate 46 is on a side that would be opposite the other pole guide cover 28. In one embodiment of the invention, the lengths of the left mounting plate 44 and right mounting plate 46 are approximately equal.

Figure 11:
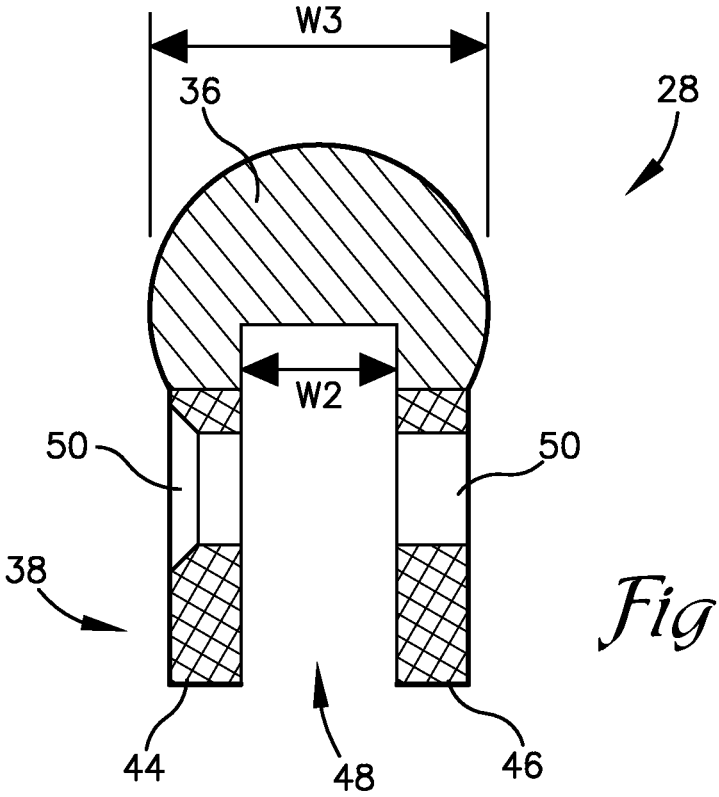
FIG. 11 is a horizontal cross-sectional view of the first embodiment of the pole guide cover through line 11-11 of FIG. 5 and illustrating the convex shape of an engagement segment and the channel.

As illustrated in FIGS. 11 and 12, the left mounting plate 44 and the right mounting plate 46 are transversely spaced a distance W2 from each other along the lengths to present a channel 48. The channel 48 is formed out of the convex exterior surface 34 of the arcuate body 30. The channel 48 serves as a pocket or recess for receiving a portion of the pole guide tong 24. In embodiments of the invention, the distance W2 that the left mounting plate 44 and the right mounting plate 46 are transversely spaced from each other is approximately equal to, or slightly greater than, a width W1 of the pole guide tong 24 to provide a close fit. The left mounting plate 44 and the right mounting plate 46 are generally parallel to each other. It should be appreciated that the left mounting plate 44 and the right mounting plate 46 are each generally arcuate to present an interior concave edge and an exterior convex edge. The left mounting plate 44 and the right mounting plate 46 further include a distal end having a leading edge, and a proximal end having a trailing edge.

The pole guide tong 24 is placed within the channel 48 by sliding the tong 24 into the channel. As noted above, the width W2 between the left and right mounting plates 44,46 is approximately the same as or slightly larger than the width W1 of the pole guide tong 24. In embodiments of the invention, the width W2 compared to the width W1 is sufficiently large to enable the pole guide tong 24 to be easily slid within the channel 48, but not so large that the pole guide tong 24 exhibits a significant amount of transverse movement within the channel 48.

In some embodiments of the invention, a plurality of openings 50 are intermittently spaced along a length of the left mounting plate 44 and the right mounting plate 46 for securing the left mounting plate 44 and the right mounting plate 46 to the pole guide tongs 24. In a particular embodiment of the invention as shown in FIGS. 3-6, each plate has five openings 50, with each opening 50 in the left mounting plate 44 being generally transversely aligned with a respective opening 50 in the right mounting plate 46. Screws, bolts, or other fasteners may be positioned through the openings 50 to secure the pole guide cover to the pole guide tong, as shown in FIG. 12 and discussed below. Additionally, more, fewer, or no openings 50 may be employed.

As used herein, the engagement segment 36 of the pole guide cover 28 is proximate to and/or engages a load 20 when the pole guide cover 28 is mounted on the pole guide tong 24. The engagement segment 36 provides an interface between the pole guide tong 24 and the load 20 to be engaged. The engagement segment 36 may extend beyond the leading edge of the pole guide tong 24 or may only be a length sufficient to provide an interface for the load 20 to be engaged.

In embodiments of the invention, the engagement segment 36 is manufactured from a polymeric material. In these embodiments of the invention, the coefficient of friction between the engagement segment 36 and the load 20 to be engaged is at least lower than the coefficient of friction between the pole guide tong 24 and the load 20 to be engaged. This enables a smoother transition as the load 20 is released and/or lowered into position. This also reduces the damage caused to the load 20 by the pole guide tongs 24, and the damage to the pole guide tongs 24 by the load 20.

The polymeric material of these embodiments of the invention may also possess relatively high tensile, shear, and/or compression strengths. The polymeric material of this embodiment of the invention may also possess a high impact resistance. These properties provide resistance to wear and degradation. Exemplary polymeric materials from which the engagement segment 36 can be formed include, but are not limited to, urethane, polyurethane, polyoxymethylene, fluorinated polymers, polystyrene, plastics, thermoplastics, and thermosetting polymers. The polymeric material also has the benefit of being inexpensive to replace if and when the pole guide cover 28 becomes damaged during use.

In other embodiments of the invention, the engagement segment 36 is formed of a metal, such as brass, copper, aluminum, or steel. In these embodiments of the invention, the engagement segment 36 has an increased useful life.

Figure 4:
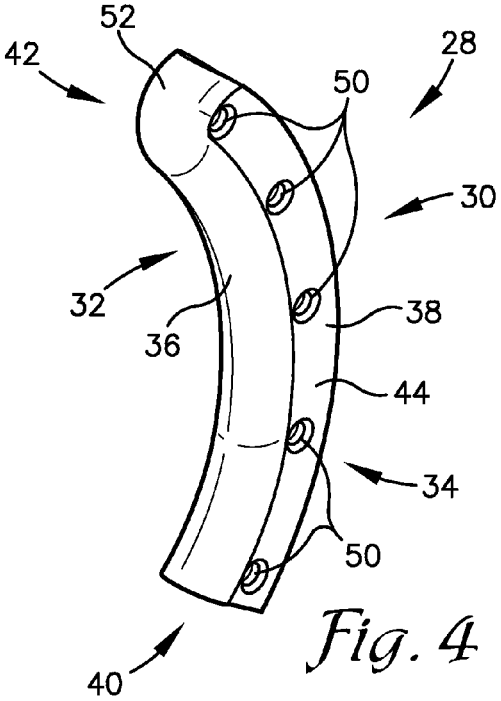
FIG. 4 is a front perspective view of a first embodiment of the pole guide cover, rotated 90 degrees along the longitudinal axis from FIG. 3.

As best shown in FIGS. 11 and 12, the engagement segment 36 has a width W3. In embodiments of the invention, as depicted in FIG. 11 and FIG. 4, the engagement segment 36 is rounded or arcuate across the width W3. This minimizes binding or snagging between the engagement segment 36 and the load 20. In other embodiments of the invention, the engagement segment 36 is generally square across the width W3. In some embodiments of the invention, the width W3 is offset and not centered on the width W2 of the channel 48. This allows the width W3 to be greater, while allowing the use of the pole guide cover 28 on existing pole guide assemblies 16 in which the pole guide tongs 24 are relatively close together in the closed position.

In embodiments of the invention, width W3 of the engagement segment 36 is greater than the width W1 of the pole guide tong 24. In these embodiments, the ratio W3:W1 is greater than 1. By way of example, in embodiments of the invention, the ratio W3:W1 can range from approximately 1-8, approximately 1.5-6, approximately 2-4, or be approximately 2.125. Alternatively stated, the ratio of W3:W1 is less than approximately 8:1, 7:1, 6:1, 5:1, 4:1, 3:1, 2:1, or 2.125:1. In one exemplary embodiment, the width W1 of the pole guide tong 24 can range from approximately 0.25-1.5 inches, approximately 0.5-1 inch, or be approximately 0.8 inch. The width W3 of the engagement segment 36 can range from approximately 0.5-3.5 inches, approximately 1-2.5 inches, approximately 1.5-2 inches, or be approximately 1.7 inches.

Larger ratios W3:W1 provide a greater surface area that is in contact with the load 20. This provides a smoother interface with the load 20 to be engaged and decreases the possibility of binding between the load 20 and the pole guide assembly 16. This also decreases the likelihood of causing damage to the load 20, which is often made of wood or other soft material. Smaller ratios W3:W1 decrease costs by requiring less material to form the pole guide cover 26 and may provide better handling of the load. Smaller ratios W3:W1 allow the pole guide cover 28 to be utilized on existing pole guide assemblies 16 in which the two pole guide tongs 24 are relatively close together in the closed position.

Figure 5:
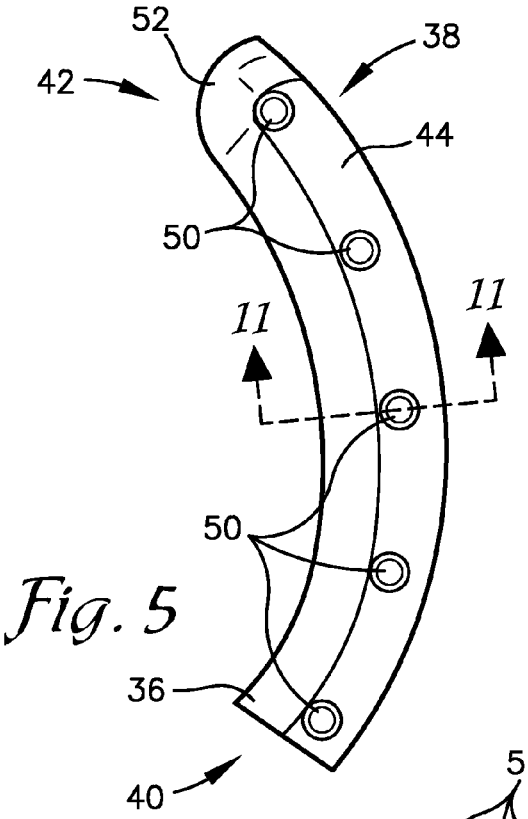
FIG. 5 is a side view of the first embodiment of the pole guide cover.
Figure 6:
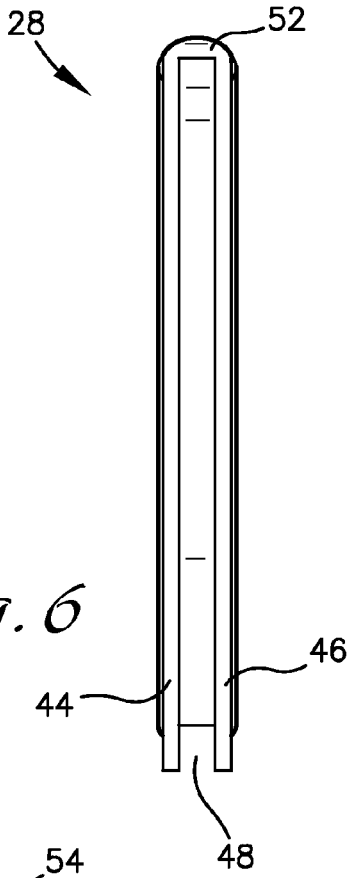
FIG. 6 is a rear end view of the first embodiment of the pole guide cover, illustrating a channel into which the pole guide tong is placed.
Figure 7:
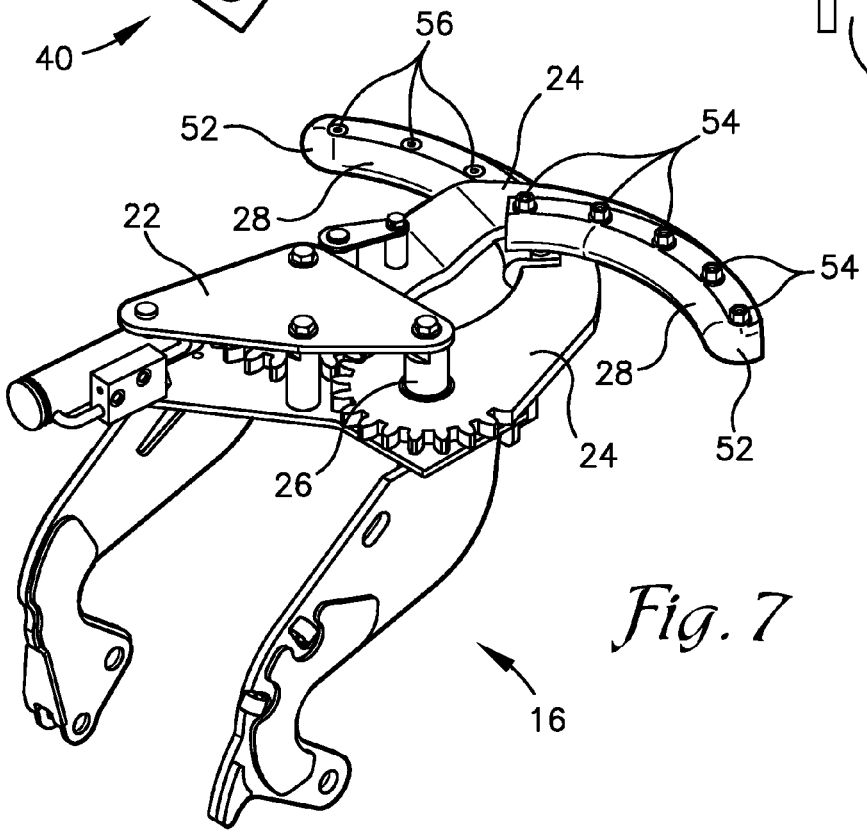
FIG. 7 is a rear perspective view of the exemplary pole guide in a closed position, illustrating the use of bolts for attachment.

As best shown in FIGS. 4 and 5, the distal end 42 of the pole guide cover 28 may comprise a bull nose 52. As used herein, "bull nose" refers to a rounded or arcuate segment that trims or otherwise covers an edge. The bull nose 52 is formed at the distal end 42 of the pole guide cover 28 to cover the leading edge of the pole guide tong 24. The bull nose 52 provides the added benefit of giving protection to the leading edge of the pole guide tong 24. In some embodiments of the invention, the bull nose 52 is a continuation of the engagement segment 36 and monolithic therewith. In other embodiments of the invention, the bull nose 52 is made of a metal or hardened polymer to provide additional protection at the leading edge of the pole guide tong 24 that is coupled with the engagement segment 36. In still further embodiments of the invention, there may be no bull nose 52, or the bull nose 52 could be removable.

As shown in FIG. 11, the mounting segment 38 of the pole guide cover 28 is proximate to and/or removably coupled to the pole guide tong 24. The mounting segment 38 is coupled with the engagement segment 36. In some embodiments of the invention, the mounting segment 38 and the engagement segment 36 are permanently coupled together, but in other embodiments of the invention, the engagement segment 36 and the mounting segment 38 are physically or mechanically coupled in a temporary or removable fashion. The mounting segment 38 has an inwardly arcuate shape similar to the shape of the engagement segment 36 and the pole guide tong 24 to which it is attached.

As noted above, the mounting segment 38 comprises a left mounting plate 44 and a right mounting plate 46 that are generally parallel to each other. The distance W2 between the two mounting plates 30 is approximately the same or slightly larger than the width W1 of the pole guide tongs 24. In other embodiments of the invention, the operator may vary the distance W2 to accommodate different pole guide tongs 24 of different widths W1.

As shown in FIG. 12, the mounting segment 38 is adapted to be securely attached to the pole guide tong 24. The mounting segment 38 may be attached to a pole guide tong 24 either physically, mechanically, or both. Attachment of the pole guide cover 28 via physical attachment may include the use of a high-strength adhesive (not illustrated) that securely attaches the pole guide cover 28 to the pole guide tong 24. Alternatively, or additionally, the pole guide cover 28 may be mechanically attached to the pole guide tong 24 with mechanical fasteners being emplaced through the openings 50.

In an exemplary embodiment of the invention illustrated in FIGS. 7-10, the mounting segment 38 is connected to the pole guide tongs 24 via a plurality of nuts 54 and bolts 56. The bolt 56 comprises a head and a distal end that is at least partially threaded. The distal end of the bolt 56 is placed through the opening 50 in the left mounting plate 44 and a corresponding opening (not illustrated) on the pole guide tong 24, until the head contacts the left mounting plate 44. Once in this position, a portion of the bolt 56 extends beyond the right mounting plate 46. The operator would then attach a nut 54, to the distal end of the bolt 56, by applying the nut to the distal and rotating the nut 54 until the nut 54 contacts the right mounting plate 46. In some embodiments of the invention, the operator continues to apply a certain amount of pressure to secure the nut 54. In some embodiments of the invention, the operator may additionally utilize at least one standard washer (not illustrated) and/or at least one locking washer (not illustrated) to minimize the damage to the left mounting plate 44 and the right mounting plate 46 caused by applying the certain amount of pressure to the nut 54.

The head of the bolt 56, in some embodiments of the invention, may be recessed into the opening 50. In these embodiments, the opening 50 has a shape to accommodate the recessed head of the bolt 56. In other embodiments, the opening 50 has a shape to recess the head of the bolt 56 even if the bolt 56 is not adapted to being recessed. As best illustrated in FIG. 9, in these embodiments the recessing of the head of the bolt 56 allows for the two pole guide covers 28 to be proximate to one another when the pole guide assembly 16 is in the closed position. In other embodiments, such as those where the ratio W3:W1 is relatively large, the head of the bolt 56 is not recessed.

The pole guide cover 28 may be connected to the pole guide tong 24 in any manner understood by one of ordinary skill in the art to achieve a secure attachment between the pole guide cover 28 and the pole guide tong 24. In embodiments of the invention, the pole guide cover 28 is removably attached to the pole guide tong 24. The pole guide cover 28 may be removed from the pole guide tong 24 and replaced with a new pole guide cover 28. This may be desirable if the engagement segment 36 degrades due to repeated use in engaging and releasing poles or loads. It may also be desirable to remove a pole guide cover 28 in the event of a defect or mechanical failure or to use the pole guide cover 28 on a different pole guide tong 24. It may also be desirable to remove a pole guide cover 28 and replace it with a different pole guide cover 28 that has a larger ratio W3:W1 if the load 20 is especially soft or fragile and requires extra care.

The mounting segment 38 is formed from a metal or polymeric material. The mounting segment 38 may be formed of the same polymeric material as the engagement segment 36 or may be a different polymeric material or a metal. In some embodiments of the invention the mounting segment 38 and engagement segment 36 are coupled together. In other embodiments of the invention, the engagement segment 36 and mounting segment 38 are unitary or monolithic.

In some embodiments of the invention, the mounting segment 38 further comprises a back mounting plate (not illustrated) that covers all or a portion of the mounting segment 38 along the convex exterior surface 34 of the pole guide cover 28. In certain embodiments of the invention, the back mounting plate is coupled with the concave exterior surface of at least one of the left mounting plate 44, the right mounting plate 46, or the bull nose 52. In this embodiment, the pole guide tong 24 is slid into the recess 48 of the pole guide cover 28, to some extent. This back mounting plate could be manufactured of metal or a polymeric material. In one embodiment of the invention, the back mounting plate is removable. In this embodiment, it can be added by the operator in a situation where additional strength and stability is desirable. The back mounting plate may also have openings (not illustrated) for at least one mounting fastener (not illustrated).

In some embodiments of the invention, a pole guide cover 28 may have the mounting segment 38 only partially cover the pole guide tong 24. In other embodiments of the invention, that the pole guide cover 28 may completely cover the pole guide tong 24. The pole guide cover may also substantially cover the pole guide tong 24 similar to a sleeve such that the distal end and the sides of the pole guide tong are enclosed by the pole guide cover 28. In other embodiments of the invention, the pole guide cover 28 covers less of the pole guide tong 24 than depicted in FIGS. 7-8.

Referring now to FIGS. 11 and 12, the pole guide cover 28 comprises a pocket 48 (or recess). The pocket 36 of the pole guide cover 28 is a recess or void that is adapted to receiving at least a portion of a pole guide tong 24, thereby allowing the pole guide cover 28 to cover at least a portion of the pole guide tong 24. The pocket 36 size and shape is defined by the dimensions of the engagement segment 36 and mounting segment 38 and has an inwardly-arcuate shape similar to the pole guide tong 24.

As illustrated in FIGS. 11 and 12, the mounting segment 38 may have openings 50 pre-drilled into it for accommodating the attachment of the pole guide cover 28 to the pole guide tong 24. In one embodiment, the openings 50 have a shape that would accommodate a recessed bolt. In other embodiments of the invention, the openings 50 would have a simple cylindrical shape to accommodate an ordinary bolt. In another embodiment, the openings 50 are of a shape other than round, such as square, rectangular, or hexagon. In this embodiment, the openings 50 are designed to accommodate a specific type of fastener. In still another embodiment, the pole guide cover 28 is manufactured without any openings 50.

While the particular length and shape of the pole guide cover 28 may vary substantially without departing from the scope, the sizes of an exemplary embodiment of the pole guide cover 28 will now be discussed. In one embodiment, pole guide cover 28 has a length within the range of from about six inches to about three feet that is specifically designed to match with a given type of pole guide tong. In another embodiment, the pole guide cover 28 is manufactured in various lengths and shapes designed to adapt to a number of existing pole guide tongs. For example, the pole guide cover 28 may come in sizes of six inches, one foot, one and one-half feet, and two feet. In this example, the operator selects the pole guide cover 28 which most closely matches the desired dimensions of the pole guide tong 24 to be covered. In other embodiments of the invention, the operator or other person may specially order a pole guide cover 28 by giving the precise dimensions required to a manufacturer of pole guide covers 26. Optionally, the operator is given various features, sizes, and materials that characterize the pole guide cover 28.

In embodiments of the invention, the pole guide cover 28 is compatible with existing pole guide tongs 24 on pole guide assemblies 16. In this respect, existing pole guide assemblies 16 may be retrofitted with pole guide covers 28 to take advantage of the one or more benefits described herein. For example, an existing pole guide tong 24 can be adapted to receive a mechanical attachment, such as by drilling openings (not illustrated) in the pole guide tong 24 that correspond to openings 50 in a pole guide cover 28. The drilling could be accomplished by mechanical means, laser, water jet cutter, or other method. In such an embodiment, the pole guide cover 28 is securely attached to the pole guide tong 24. Alternatively, or additionally, the pole guide cover 28 may be secured to the pole guide tong via chemical means such as with applying an adhesive to the pole guide tong 24 prior to putting the pole guide cover 28 in place or welding the mounting segment 38 to the pole guide tong 24.

In other embodiments of the invention, the pole guide tongs 24 are originally manufactured to have openings (not illustrated) that correspond with the openings 50 in the pole guide cover. In still another embodiment, the pole guide tongs 24 are manufactured and/or sold with the pole guide cover 28 already attached thereto. In yet further embodiments of the invention, the operator may selectively add and remove the pole guide covers 26 from the pole guide tongs 24 as required by the specific application. The operator, according to another embodiment, could also employ a number of different types, shapes, and sizes of pole guide cover 28 based upon the specific application.

Although the invention has been described with reference to the exemplary embodiments illustrated in the attached drawings, it is noted that equivalents may be employed and substitutions made herein without departing from the scope of the invention as recited in the claims. For example, while the assembly has been illustrated and described as including two load-securing pole guide tongs 26, it will be appreciated that more than two pole guide tongs may alternatively be included and used to engage the load. Furthermore, the mounting hardware represents one, exemplary method of mechanically connecting the pole guide cover 28 and pole guide tong 24. Other methods may be used without departing from the scope of the invention including, by way of example, a screw.

Having thus described various embodiments of the invention, what is claimed as new and desired to be protected by Letters Patent includes the following:

1. A pole guide cover for covering at least a portion of a pole guide tong of a pole guide assembly, said pole guide tong being generally arcuate to present a concave interior surface and a convex exterior surface along a length of the pole guide tong, and wherein the concave interior surface is operable to at least partially engage a load, the pole guide cover comprising:

an arcuate body having a length and including a rounded engagement segment formed of a hardened polymeric material along the length of the arcuate body and a mounting segment along the length of the arcuate body, wherein the mounting segment comprises a lower mounting plate and an upper mounting plate;

a channel formed in at least a portion of the length of the convex exterior surface between the lower mounting plate and the upper mounting plate, wherein the channel is shaped to complementally receive at least a portion of the length of the concave interior surface of the pole guide tong, wherein the mounting segment includes a plurality of openings in each of the lower mounting plate and the upper mounting plate, wherein the plurality of openings are configured to receive a plurality of fasteners, traversing the channel, to removably secure the pole guide cover to the pole guide tong.

2. The pole guide cover of claim 1, wherein upon mounting the pole guide cover to the pole guide tong, the pole guide cover creates a buffer between the pole guide tong and the load being acted upon by the pole guide assembly.

3. The pole guide cover of claim 1, wherein the engagement segment presents a concave interior surface and a convex exterior surface, such that the interior surface of the engagement segment is said concave interior surface of the arcuate body; and wherein the mounting segment presents a concave interior surface and a convex exterior surface, such that the exterior surface of the mounting segment is said convex exterior surface of the arcuate body.

4. The pole guide cover of claim 3, further comprising:

a bull nose segment coupled to a leading edge of the engagement segment, wherein the bull nose segment is adapted to cover at least a portion of a leading edge of the pole guide tong.

5. The pole guide cover of claim 1, wherein the mounting segment is formed of a metal.

6. The pole guide cover of claim 1, wherein the engagement segment and mounting segment are both formed of a single hardened polymeric material and are monolithic.

7. The pole guide cover of claim 1, further including a plurality of fasteners to be placed through the plurality of openings in the lower mounting plate and the upper mounting plate to removably secure the pole guide cover to the pole guide tong.

8. The pole guide cover of claim 1, wherein the lower mounting plate and the upper mounting plate are each coupled with the engagement segment.

9. The pole guide cover of claim 1, wherein the lower mounting plate and the upper mounting plate are substantially parallel to each other and separated by a distance.

10. The pole guide cover of claim 1, wherein the mounting segment further comprises:

a back mounting plate, wherein the back mounting plate is coupled to at least a portion of the lower mounting plate and a portion of the upper mounting plate, wherein the back mounting plate is opposite the engagement segment.

11. A pole guide cover for covering at least a portion of a pole guide tong of a pole guide assembly, said pole guide tong being generally arcuate to present a concave interior surface and a convex exterior surface along a length of the pole guide tong, and wherein the concave interior surface is operable to at least partially engage a load, the pole guide cover comprising:

an arcuate body having a length and presenting a concave interior surface including a rounded engagement segment formed of a hardened polymeric material along the length of the arcuate body and a convex exterior surface along the length of the arcuate body, wherein the arcuate body is curved along the length to form the concave interior surface and the convex exterior surface;

a channel formed in at least a portion of the length of the convex exterior surface, wherein the channel is shaped to complementally receive at least a portion of the length of the concave interior surface of the pole guide tong; and a mounting assembly for removably mounting the pole guide cover to the pole guide tong, wherein the mounting assembly includes a lower mounting plate and an upper mounting plate, wherein the lower mounting plate and the upper mounting plate are substantially parallel to each other and separated by a distance, wherein the lower mounting plate and the upper mounting plate each include a plurality of openings configured to receive a plurality of fasteners, traversing the distance, to removably secure the pole guide cover to the pole guide tong, wherein the engagement segment overlays the distance separating the upper mounting plate and lower mounting plate.

12. The pole guide cover of claim 11, wherein the engagement segment presents a concave interior surface and a convex exterior surface, such that the interior surface of the engagement segment is said concave interior surface of the arcuate body; and wherein the mounting segment presents a concave interior surface and a convex exterior surface, such that the exterior surface of the mounting segment is said convex exterior surface of the arcuate body.

13. The pole guide cover of claim 11, wherein the mounting segment is formed of a metal.

14. The pole guide cover of claim 11, wherein the engagement segment and mounting segment are both formed of a single hardened polymeric material and are monolithic.

15. The pole guide cover of claim 11, further including a plurality of fasteners to be placed through the plurality of openings in the lower mounting plate and upper mounting plate to removably secure the pole guide cover to the pole guide tong.

16. The pole guide cover of claim 11, wherein the mounting segment further comprises:

a back mounting plate coupled to at least a portion of the lower mounting plate and a portion of the upper mounting plate, wherein the back mounting plate is opposite the engagement segment.

* * * * *